US006979949B2

(12) United States Patent
Yonezawa et al.

(10) Patent No.: US 6,979,949 B2
(45) Date of Patent: Dec. 27, 2005

(54) FLUORESCENT LUMINOUS TUBE WITH GETTER MIRROR FILM

(75) Inventors: Yoshihisa Yonezawa, Mobara (JP); Yukio Ogawa, Mobara (JP); Shogo Ishige, Mobara (JP)

(73) Assignee: Futaba Corporation, Mobara (JP)

( * ) Notice: Subject to any disclaimer, the term of this patent is extended or adjusted under 35 U.S.C. 154(b) by 104 days.

(21) Appl. No.: 10/189,391

(22) Filed: Jul. 8, 2002

(65) Prior Publication Data

US 2003/0006703 A1 Jan. 9, 2003

(51) Int. Cl.[7] ..... H01J 19/70
(52) U.S. Cl. ..... 313/553; 313/495; 313/547; 313/481; 417/51
(58) Field of Search ..... 313/495–497, 313/549, 553, 558–561, 547, 422, 563, 551, 313/481; 445/24, 25, 6, 53, 55; 417/48–51; 252/181.1–181

(56) References Cited

U.S. PATENT DOCUMENTS 5,977,706 A * 11/1999 Cho et al. ..... 313/553
6,396,207 B1 * 5/2002 Hasegawa et al. ..... 313/495
6,541,912 B1 * 4/2003 Fritz et al. ..... 313/553
6,642,648 B1 * 11/2003 Cooper ..... 313/495
6,717,350 B2 * 4/2004 Yonezawa et al. ..... 313/495
6,838,822 B2 * 1/2005 Yonezawa et al. ..... 313/562

* cited by examiner

*Primary Examiner*—Karabi Guharay
*Assistant Examiner*—German Colón
(74) *Attorney, Agent, or Firm*—Oblon, Spivak, McClelland, Maier & Neustadt, P.C.

(57) ABSTRACT

A fluorescent luminous tube is provided that has a getter mirror film formed in an arbitrary shape by illuminating a laser beam onto a getter. In order to form the getter film 32, the rectangular ring-less getter 31 mounted on the anode substrate 11 is irradiated with the laser beam L from the outside of the front substrate 12 and thus is evaporated. In this process, when the illumination spot of the laser beam L is moved along the scanning line 33, the rectangular getter mirror film 32 is formed around the scanning line 33. The burnt region 34, which has the same shape and size as those of the scanning line 33, is formed using the laser beam L.

4 Claims, 7 Drawing Sheets

FLUORESCENT LUMINOUS TUBE WITH GETTER MIRROR FILM

BACKGROUND OF THE INVENTION

1. Field of the Invention

The present invention relates to a fluorescent luminous tube wherein any desired shape of a getter mirror film is formed by scanning a getter material with a laser beam.

2. Description of the Prior Art

FIG. 6 is a plan view and a cross-sectional view partially, each illustrating a conventional fluorescent luminous tube of a type provided with a ring getter. FIG. 6(*a*) is a plan view illustrating an anode substrate. FIG. 6(*b*) is a cross-sectional view illustrating the portion taken along the line Y1—Y1 of FIG. 6(*a*). FIG. 6(*c*) is a plan view illustrating a getter material and a getter mirror film.

Referring to FIGS. 6(*a*), 6(*b*) and 6(*c*), numeral 51 represents an anode substrate formed of an insulating material such as glass, ceramic, or the like. Numeral 52 represents a front substrate such as glass. Numerals 531 to 533 represent side members such as glass. Letter A represents an anode electrode on which a fluorescent substance is coated. Numeral 611 represents a getter material. Numeral 612 represents an iron-made ring container plated with nickel. Numeral 521 represents a display area. The ring getter is formed of the ring container 612 and the getter material 611. The ring container 612 is mounted on the support 613 which is firmly fixed to the push plate 614 mounted on the anode substrate 51.

When the ring container 612 is heated by a radio-frequency induction heating method, the getter material 611 evaporates and spatters out in the directions of the arrows to form a getter mirror film 62 on the inner surface of the front substrate 52. The getter mirror film 62 must be formed on a limited area outside the display area 521 on the front substrate 52.

FIG. 6(*c*) shows the relationship between the ring getter 611 and the getter mirror film 62. The diagram is shown so as to superpose the getter material 611 on the getter mirror film 62. The size of the getter mirror film 62 depends on the diameter of the getter material 611 and the distance between the aperture of the ring container 611 and the inner surface of the front substrate 52 (because a getter mirror film is formed while the getter material is expanding). The shape of the getter mirror film 62 depends on the shape of the ring getter material 611.

FIG. 7 shows an example of a getter of a type, which is heated by a direct conduction resistance heating method. Like numerals are attached to the same elements as those in FIG. 6.

Referring to FIGS. 7(*a*), 7(*b*) and 7(*c*), numeral 711 represents a getter material, 712 represents a linear container which generates heat by conduction, and 713 represents a support/conduction lead member. The linear container 712 is firmly fixed to the support/conduction lead member 713. The support/conduction lead member 713 is firmly fixed to the anode substrate 51. Both the ends of the support/conduction lead member 713 are pinched between the side member 532 and the anode substrate 51 and are led out externally. Each of the lead-out portions acts as a terminal for energizing the linear container 712.

When an electric current flows via the support/conduction lead members 713, the linear container 712 is heated because of the resistance of the container itself. Thus, the getter material 711 evaporates and spatters in the directions of the arrows so that the getter mirror film 72 is formed on the inner surface of the front substrate 52.

In this operation, the getter mirror film 72 becomes oval, as shown in FIG. 7(*c*). The size of the getter mirror film 72 depends on the size of the getter material 711 and the distance between the getter material 711 and the inner surface of the front substrate 52, as shown in FIG. 6. The shape of the getter mirror film 72 depends on the shape of the getter material 711.

In the structure shown in FIGS. 6 and 7, the size and shape of the getter mirror film is uniquely determined automatically by the size and shape of the getter. For that reason, the size and shape of the getter mirror film cannot be controlled arbitrarily. Namely, provided that the distance between a getter and the front substrate is fixed, the size of the getter mirror film depends on the size of the getter. In accordance with the size of the place where a getter mirror film is formed, a getter having the size suitable for the place must be selected. Moreover, since the size of a getter mirror film depends on the size of a getter, the getter mirror film becomes circular or oval even if the place on which the getter mirror film is formed is, for example, rectangular. Hence, when a circular getter mirror film is formed at a rectangular place, the corners of the rectangular place become dead spaces. The getter mirror film must be formed outside the display area of the front substrate. However, when the position of a getter is shifted three-dimensionally, the getter mirror film may be formed inside the display area. Such a displacement results in a defective fluorescent luminous tube. For that reason, mounting an envelope filled with a getter material requires a high precision and takes much time for positioning. To mount the envelope with low precision, the position of a getter must be separated sufficiently from the display area, so that the dead space becomes larger.

SUMMARY OF THE INVENTION

The present invention is made to solve the above-mentioned problems.

An object of the invention is to provide a fluorescent luminous tube wherein a getter mirror film can be formed in a desired size and shape, without mounting a getter with high precision and regardless of the size and shape of a getter material.

In a fluorescent luminous tube according to the present invention, a laser beam is illuminated onto a getter mounted inside an envelope from the outside of the envelope and the illumination spot of the laser beam is moved along a scanning line in a predetermined shape. Thus, a getter mirror film, which has the shape corresponding to the shape of the scanning line, is formed on the inner surface of the envelope through which the laser beam passes. A burnt region, which has substantially the same size and shape as those of said scanning line, is formed in the getter mirror film.

In the fluorescent luminous tube of the present invention, the envelope comprises a first substrate and a second substrate, which confront each other, and side members, and the getter is mounted on the first substrate or on the second substrate.

In the fluorescent luminous tube of the present invention, the distance between the laser beam illumination surface of the getter and the inner surface of the first substrate or the second substrate or each of the side members is 1 mm or less and the beam diameter of the laser beam is 100 $\mu$m or less.

In the fluorescent luminous tube of the present invention, the getter is formed through press-molding a getter material.

In the fluorescent luminous tube of the present invention, the getter comprises a two layered structure of a getter material layer and a metal layer.

BRIEF DESCRIPTION OF THE DRAWINGS

This and other objects, features, and advantages of the present invention will become more apparent upon a reading of the following detailed description and drawings, in which:

FIG. 1(*b*) is a cross-sectional view partially illustrating a fluorescent luminous tube with a circular getter mirror film, according to a first embodiment of the present invention;

FIG. 1(*c*) is a diagram illustrating a ring-less getter, according to a first embodiment of the present invention;

FIG. 1(*d*) is a diagram illustrating a getter mirror film, according to a first embodiment of the present invention;

FIG. 2(*b*) is a cross-sectional view partially illustrating a fluorescent luminous tube with a rectangular getter mirror film, according to a second embodiment of the present invention;

FIG. 2(*c*) is a diagram illustrating a ring-less getter, according to a second embodiment of the present invention;

FIG. 2(*d*) is a diagram illustrating a getter mirror film, according to a second embodiment of the present invention;

FIG. 4(*b*) is a plan view illustrating a front substrate with a rectangular frame-shaped getter mirror film, according to a third embodiment of the present invention;

FIG. 6(*b*) is a cross-sectional view partially illustrating a conventional fluorescent luminous tube with a ring getter mirror film;

FIG. 6(*c*) is a diagram illustrating a ring getter material and a getter mirror film in a conventional fluorescent luminous tube;

FIG. 7(*b*) is a cross-sectional view partially illustrating a conventional fluorescent luminous tube with a linear getter; and FIG. 7(*c*) is a diagram illustrating a getter material and a getter mirror film in a conventional fluorescent luminous tube.

DETAILED DESCRIPTION OF THE PREFERRED EMBODIMENT

Figure 1A:
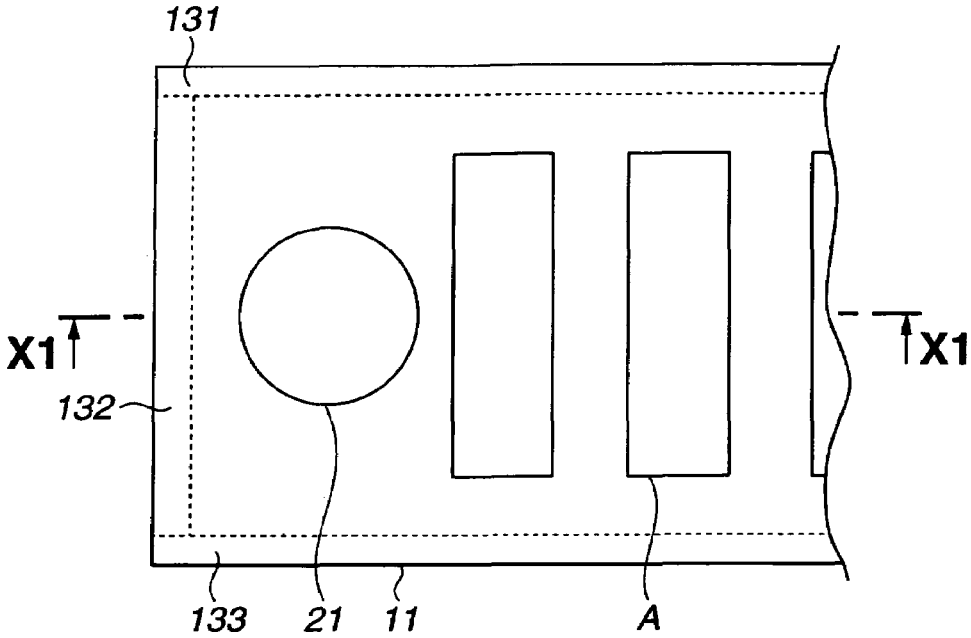
FIG. 1(*a*) is a plan view partially illustrating a fluorescent luminous tube with a circular getter mirror film, according to a first embodiment of the present invention.
Figure 1B:
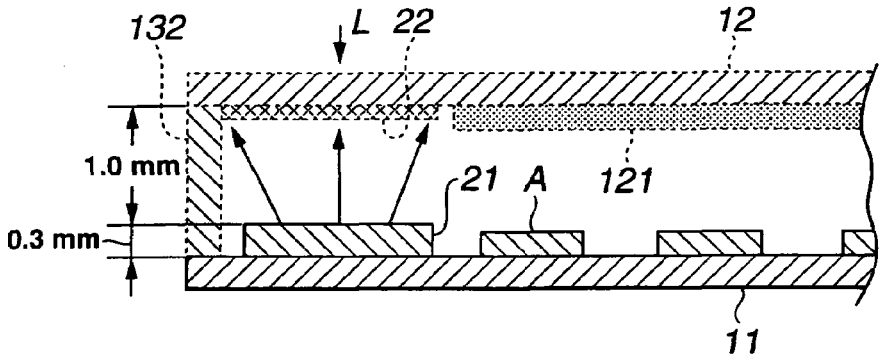
Figure 1C:
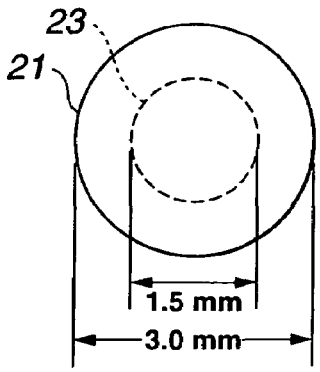
Figure 1D:
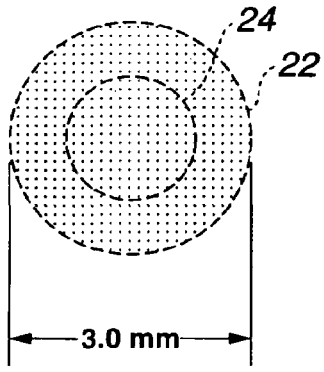
Figure 2A:
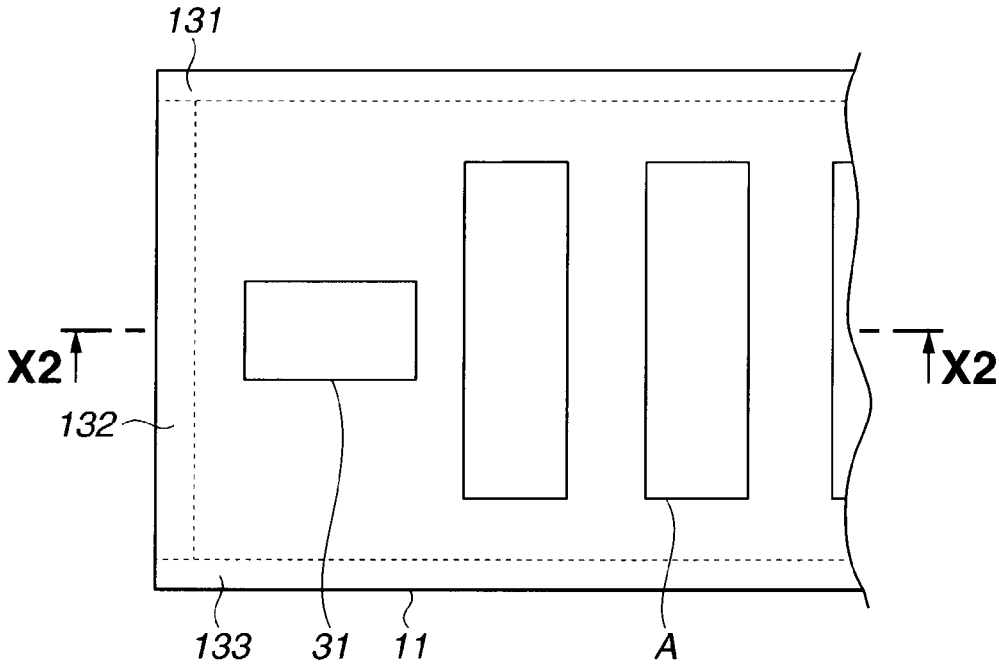
FIG. 2(*a*) is a plan view partially illustrating a fluorescent luminous tube with a rectangular getter mirror film, according to a second embodiment of the present invention.
Figure 2B:
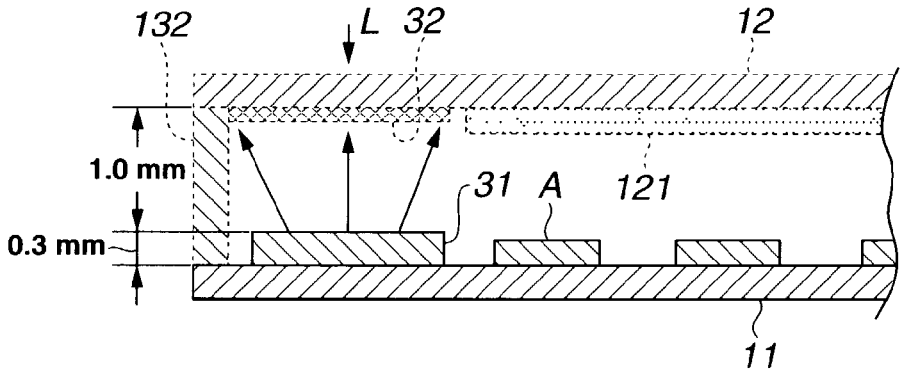
Figure 2C:
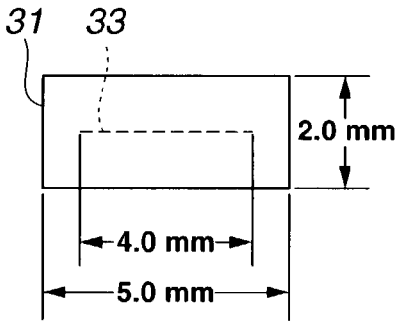
Figure 2D:
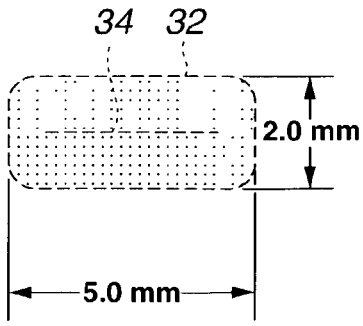
Figure 3A:
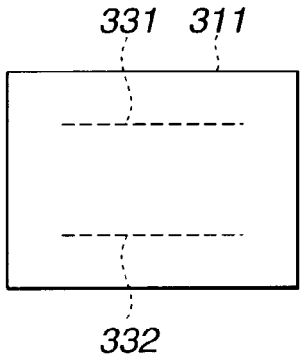
FIGS. 3(*a*) and 3(*b*), 3(*c*) and 3(*d*), and 3(*e*) and 3(*f*) are diagrams each illustrating a modification of a getter mirror film of FIG. 2.
Figure 3B:
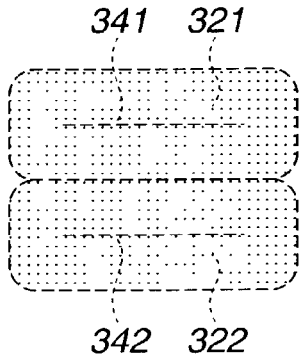
Figure 3C:
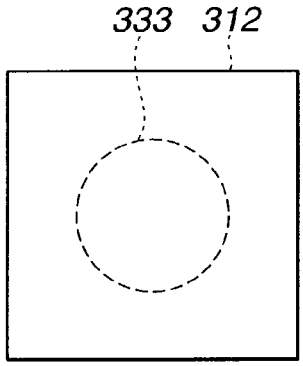
Figure 3D:
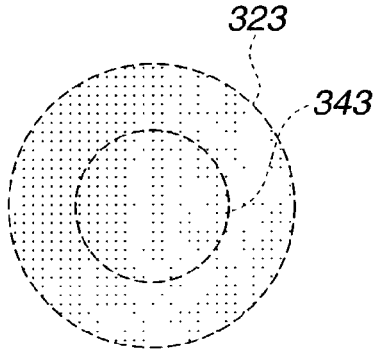
Figure 3E:
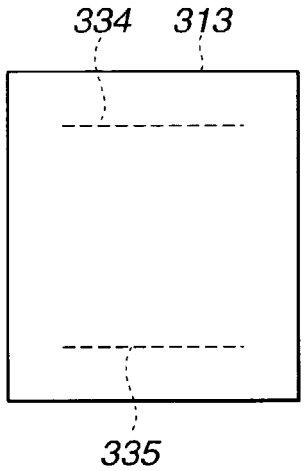
Figure 3F:
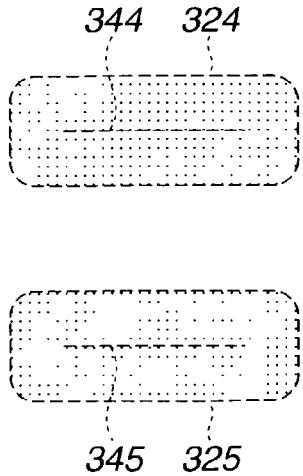

FIG. 1 is a plan view and a cross-sectional view, each illustrating a fluorescent luminous tube with a circular getter mirror film formed by a laser beam, according to a first embodiment of the present invention. FIG. 1(*a*) is a plan view partially illustrating an anode substrate. FIG. 1(*b*) is a cross-sectional view partially illustrating a portion taken along the line X1—X1 of FIG. 1(*a*).

Referring to FIGS. 1(*a*), 1(*b*) and 1(*c*), numeral 11 represents a translucent or non-translucent anode substrate formed of an insulating material such as ceramic. Numeral 12 represents a translucent front substrate acting as a base member, formed of an insulating material such as glass or ceramic. Each of numerals 131 to 133 represents a translucent or non-translucent side plate (side member) formed of an insulating material such as glass or ceramic. Numeral 21 represents a ring-less getter formed of barium, aluminum, and others. Numeral 22 represents a getter mirror film which absorbs a gas (or undesired gas) to maintain the vacuum degree inside an envelope. Numeral 23 represents a scanning line of a laser beam L (a laser beam such as YAG laser or $CO_2$ laser). Numeral 24 represents a burnt region in a getter mirror film. Numeral 121 represents a display area (an area where a getter mirror film is not formed) on the side of the front substrate 12. Letter A represents an anode electrode on which a fluorescent substance acting as an anode is coated. The anode substrate 11, the front substrate 12, and side members 131 to 133 consists of an envelope for a fluorescent luminous tube (in Figures, the side member opposing the side plate 132 is omitted).

With the distance between the anode substrate and the front substrate being several 100 $\mu$m, a translucent side member made of a molten glass rod may be used or a translucent sealing member may be used to the side member.

The fluorescent luminous tube includes cathode filaments each acting as a cathode (however, field-emission cathodes are used in a field-emission fluorescent tube), anchors each for mounting a filament, filament mounting supports (however, the anchors and supports are excluded from fluorescent luminous tubes of a type), a grid (however, excluded from a diode-type fluorescent display tube), anode wiring conductors, cathode wiring conductors, grid wiring conductors, and inter-laminar insulating layers (however, excluded from fluorescent luminous tubes of a type). Here, these elements are omitted in explanation. The present invention is characterized by the position of a getter, the position where a getter mirror film is formed, and the getter mirror film forming method.

The ring-less getter 21 does not require the conventional ring container filled with a getter material. For example, the ring-less getter is formed by press-molding getter material powders or by press molding getter material powders and metal (or aluminum) powders or press-molding laminated metal layers. Moreover, the ring-less getter may be formed of a two-layered structure of a getter material layer and a metal layer or of a getter material press-molded together with a reinforced member such as a metal plate. The ring-less getter may be formed by bonding a getter with a hole or groove to a metal layer formed on a substrate by means of wires. The ring-less getter may be formed by preparing a getter which has a metal wire integrated in the inside thereof or attached to the outside thereof and firmly fixing the getter onto a metal layer on a substrate with the wire through ultrasonic bonding.

The ring-less getter 21 is formed of a metal (Ba, Mg) having a gas absorption capability or an alloy of the metal (e.g. a BaAl alloy or MgAl alloy). If necessary, an additive metal (Ni, Ti, Fe, Zr) for generation of heat reaction is mixed to the gas absorption metal. When light energy (particularly, a laser beam) is used to flash a getter, the additive metal can be omitted. This enables the fabrication costs of a getter and the size thereof to be reduced. Thus, the fluorescent display tube can be more slimmed and thinned. This feature is applicable to the ring-less getters in the following embodiments.

The ring-less getter 21 is firmly fixed to the anode substrate 11 with a fritted glass. With the ring-less getter 21 in the two-layered structure, a metal layer or a metal film, for example, a thin or thick aluminum film formed through spatter deposition or screen printing, is formed on the anode substrate 11. The metal film of the ring-less getter can be fixed to the metal layer or film through the ultrasonic bonding.

In the present embodiment, using the ring-less getter 21 having a diameter of 3 mm and a thickness of 0.3 mm, the distance between the ring-less getter 21 and the inner surface of the front substrate 12 is set to 1 mm. As the distance between the ring-less getter 21 and the inner surface of the front substrate increases, the area of the getter mirror film becomes larger with respect to the beam diameter of a laser beam. Therefore, it is desirable that the distance is set as short as possible (preferably, is set to 1 mm or less) to form the getter mirror film analog to the scanning shape of the laser beam. A laser marker in a scanning system is used to form a getter mirror. The moving rate of the illumination spot of the laser beam L is 100 mm/sec and the Q switch frequency is 5 kHz and the lamp current is 20 A and the beam spot of the laser beam L is set to 50 $\mu$m. The beam diameter of the laser beam L may be 100 $\mu$m or less. The getter film spreads out from both sides of the scanning line of the laser beam. The spread of the getter film is proportional to the beam diameter of a laser beam. In order to suppress of the spread of the getter film, it is desirable to reduce the beam diameter of the laser beam to be as small as possible.

The laser beam L is illuminated onto the ring-less getter 21 from the outside of the translucent front substrate. The illumination spot of the laser beam L moves along the circular scanning line 23 having a diameter of 1.5 mm in FIG. 1(*c*). Thus, a getter-material evaporated portion having substantially the same shape as that of the scanning line 23 is formed in the laser illumination surface of the ring-less getter 21. The getter mirror film 22 having a diameter of 3 mm is formed on the inner surface of the front substrate 12, as shown in FIG. 1(*d*). The shape of the getter mirror film 22 corresponds to that of the scanning line 23. That is, the scanning line 23 in a circular form (the trace of a laser beam) results in the getter mirror film in a circular form.

The laser beam L strikes the ring-less getter 21 through the front substrate 12 and spatters particles of the evaporated getter material in the directions of the arrows. Thus, the getter mirror film 22 is deposited on the inner surface of the front substrate 12. Meanwhile, because the laser beam L illuminates the resultant getter mirror film 22, the laser beam illuminated portion in the getter mirror film 22 evaporates. The laser beam L, which has the energy of evaporating the getter material of the ring-less getter 21, can instantaneously evaporate the laser beam illuminated portion. As a result, the getter material evaporated portion, or the burnt region 24, is formed in the getter mirror film 22. The burnt portion 24 has a diameter of about 1.5 mm and has substantially the same size and shape as those of the scanning line 23. The diameter of the scanning line 23 set to less than 1.5 mm results in the getter mirror film 22 having a diameter of less than 3 mm.

The line width of the burnt region 24 is about 50 $\mu$m, which is substantially equal to the beam diameter of the laser beam L. The burnt region of that size does not cause the getter function of the getter mirror film to be deteriorated. Because the shape and size of the burnt region are substantially the same as those of the scanning line 23, the shape and the size of the scanning line 23 can be checked through the burnt region 24. Namely, the burnt region 24 can be utilized to ascertain the scanning line 23. This feature is applicable to the burnt regions in the following embodiments.

The ring-less getter 21 may be mounted on the front substrate 12 to form the getter mirror film 22 on the anode substrate 11. The illumination spot of the laser beam is scanned at least once along a scanning line (a virtual line showing a predetermined scanning pattern (at least on a laser illumination surface of a getter) of a laser beam). The illumination spot of a laser beam may be scanned plural times (twice or more) along or over the scanning line. The multiple scanning step has the advantage in that the laser beam can be reduced to a low power, so that an adverse effect on the envelope is further reduced compared with one-time scanning step.

FIG. 2 is a plan view and a cross-sectional view, each partially illustrating a fluorescent luminous tube with a rectangular getter mirror film formed by means of a laser beam, according to a second embodiment of the present invention. FIG. 2(*a*) is a plan view partially illustrating an anode substrate. FIG. 2(*b*) is a cross-sectional view illustrating the portion taken along the line X2—X2 of FIG. 2(*a*). Like numerals are attached to the same elements as those in FIG. 1.

Referring to FIGS. 2(*a*), 2(*b*) and 2(*c*), numeral 31 represents a ring-less getter, 32 represents a getter mirror film, 33 represents a laser beam scanning line, and 34 represents a burnt region.

In this embodiment, a ring-less getter 31 of 2 mm×5 mm×0.3 mm is used. The distance between the ring-less getter 31 and the inner surface of the front substrate 12 is set to 1.0 mm. In the getter mirror formation, a laser marker in the scanning system is used and is set to the same conditions as those in FIG. 1.

The laser beam L is illuminated onto the ring-less getter 31 from the outside of the front substrate 12. The laser beam L is moved along the linear scanning line 32 of 4 mm in length (as shown in FIG. 2(*c*)). As a result, the getter mirror film 32 of 2 mm×5 mm is formed on the inner surface of the front substrate 12, as shown in FIG. 2(*d*). The shape of the getter mirror film 32 corresponds to the shape of the scanning line 33. Namely, the getter mirror film 32 has the width widened from the linear scanning line 33. The linear burnt region 34, which is 4 mm in length being substantially the same length as that of the scanning line 33, is formed on the getter mirror film 32.

The ring-less getter 31 may be mounted on the front substrate 12 to form the getter mirror film 32 on the anode substrate 11.

In the inner surface of the front substrate 12, the space where a getter mirror film can be formed is generally rectangular. Hence, the rectangular getter mirror film 32 allows the empty space in the inner surface of the front substrate 12 to be effectively used.

In the present embodiment, the side member 132 having a translucency allows the laser beam to be illuminated through the side surface of the ring-less getter 31, so that a getter mirror film can be formed on the inner surface of the side plate 132.

Similarly, a getter mirror film can be formed on the inner surface of the side plate 133 or 131. It is desirable that the area of the getter mirror film is larger because the display quality is improved.

FIG. 3 is a diagram illustrating modifications of the embodiment in FIG. 2. Referring to FIGS . 3(*a*) and 3(*b*), a ring-less getter 311 (4 mm×5 mm) of twice as large as the ring-less getter 31 of FIG. 2(*c*) is used. The illumination spot of a laser beam travels along the linear scanning lines 331 and 332 spaced away 2 mm to form continuously the getter mirror film 321 corresponding to the scanning line 331 and the getter mirror film 322 corresponding to the scanning line 332. The total area (4 mm×5 mm) of the getter mirror films 321 and 322 is twice the area of the getter mirror film 32 in FIG. 2(*d*). The linear burnt region 341 having substantially the same shape and size as those of the scanning line 331 is formed in the getter mirror film 321. The linear burnt region 342 having substantially the same shape and size as those of the scanning line 332 is formed in the getter mirror film 322.

A rectangular ring-less getter 312 is used in FIGS. 3(*c*) and 3(*d*). The illumination spot of a laser beam is moved along a circular scanning line 333 to form a circular getter mirror film 323 corresponding to the scanning line 333. That is, the shape of the getter mirror film 323 depends on the shape of the scanning line 333, rather than the shape of the ring-less getter 312. When the ring-less getter 312 and the getter mirror film 323 are different in shape, the amount of the getter material which does not contribute to the formation of the getter mirror film become large. For that reason, it is desirable that the ring-less getter 312 and the getter mirror film 323 have the same shape. It is desirable that the ring-less getter 312 and the scanning line 343 have substantially the same shape, that is, that the ring-less getter 312 is shaped in a doughnut form. This approach may increase the amount of the getter material that does not contribute to the formation of the getter mirror film. However, standardizing the shape and size of a getter can lead to reduction of costs, sharing of manufacturing apparatuses, and improvement of yields. A circular burnt region 343, which has substantially the same shape and size as those of the scanning line 343, is formed in the getter mirror film 323.

Referring to FIGS. 3(*e*) and 3(*f*), a ring-less gettter 313 (6 mm×5 mm), which has an area three times the area of the ring-less getter 31 in FIG. 2(*c*), is used. The illumination spot of a laser beam is moved along the linear scanning lines 334 and 335 spaced away by 4 mm. Thus, a getter mirror film 324 corresponding to the shape of the scanning line 334 and a getter mirror film 325 corresponding to the shape of the scanning line 335 are formed. The total area (4 mm×5 mm) of the getter mirror films 324 and 325 is twice the area of the getter mirror film 32 shown in FIG. 2(*d*). The linear burnt region 344 which has substantially the same shape and size as those of the scanning line 334 is formed in the getter mirror film 324. The linear burnt region 345 which has substantially the same shape and size as those of the scanning line 335 is formed in the getter mirror film 325.

The spacing between the scanning lines 334 and 335 is 4 mm but can be determined arbitrarily. The getter mirror 324 can be formed at a desired place by merely changing the position of the scanning line 334 and the getter mirror 325 can be formed at a desired place by merely changing the position of the scanning line 335. Moreover, the getter mirror film 324 having a desired size can be formed by changing the length of the scanning line 334 and the getter mirror film 325 having a desired size can be formed by changing the length of the scanning line 335. In this case, the burnt region 344 depends on the position or length of the scanning line 334. The burnt region 345 depends on the position or length of the scanning line 335.

Figure 4A:
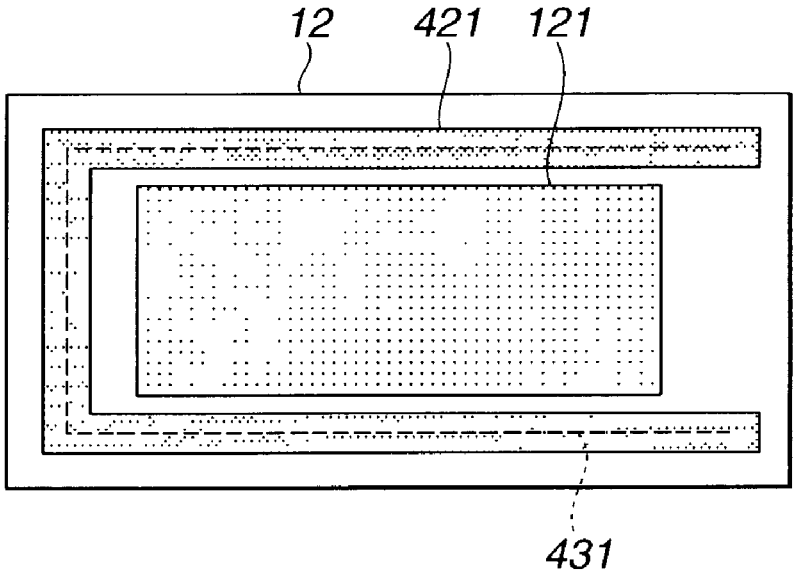
FIG. 4(*a*) is a plan view illustrating a front substrate with a U-shaped getter mirror film, according to a third embodiment of the present invention.
Figure 4B:
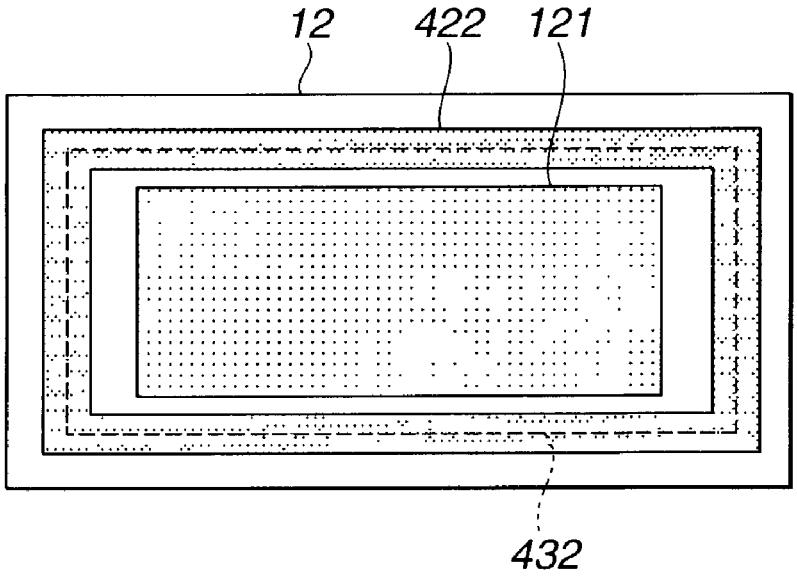
Figure 5A:
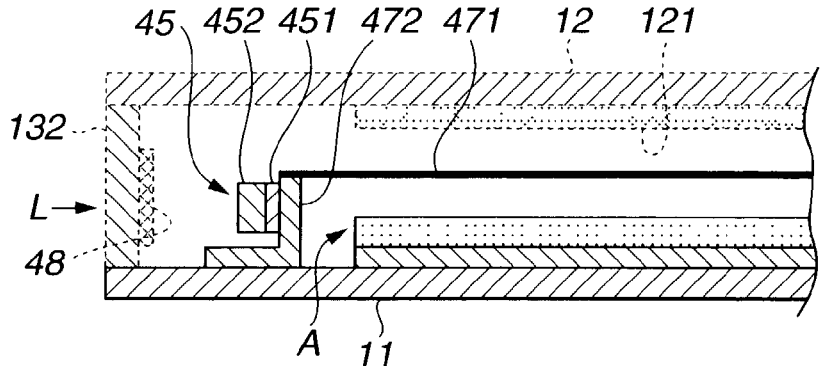
FIGS. 5(*a*), 5(*b*), 5(*c*), and 5(*d*) are cross-sectional views each partially illustrating a fluorescent luminous tube with a getter mounting place and with a getter mirror film forming place, according to a fourth embodiment of the present invention.
Figure 5B:
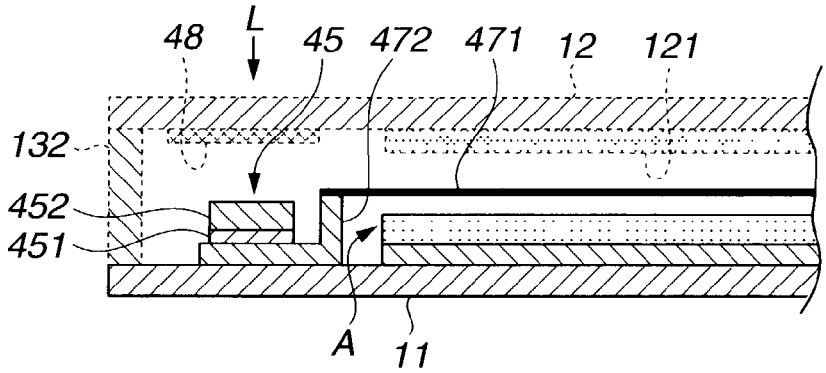
Figure 5C:
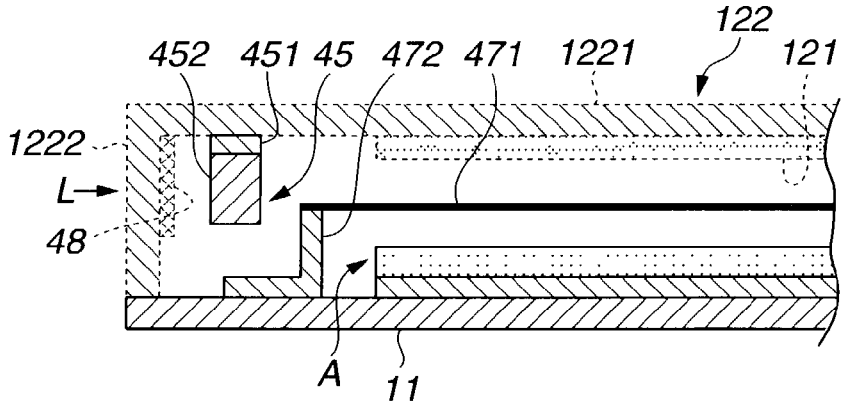
Figure 5D:
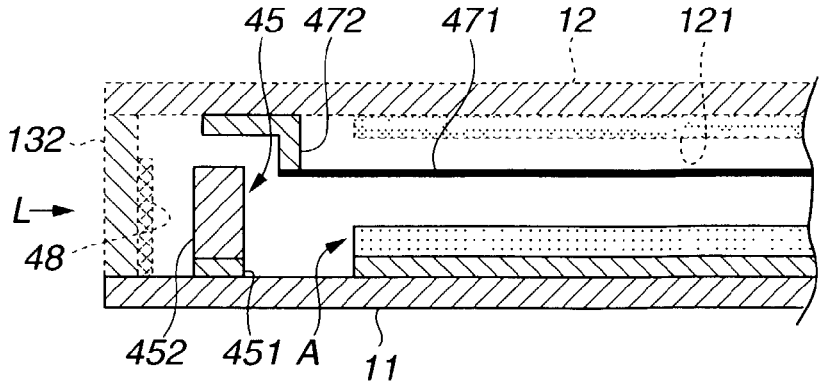
Figure 6A:
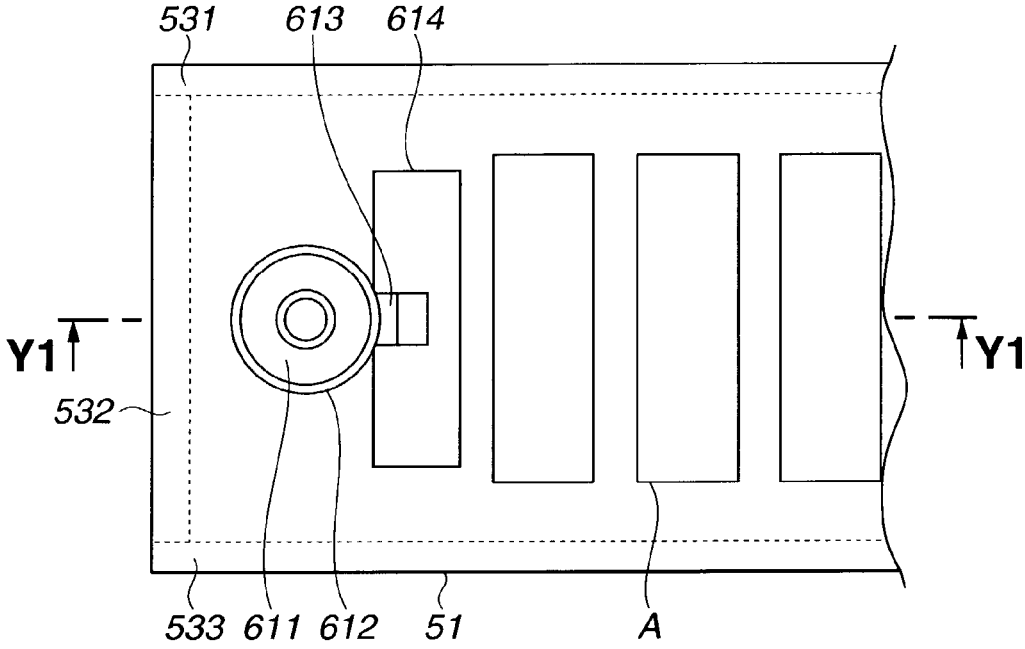
FIG. 6(*a*) is a plan view partially illustrating a conventional fluorescent luminous tube with a ring getter.
Figure 6B:
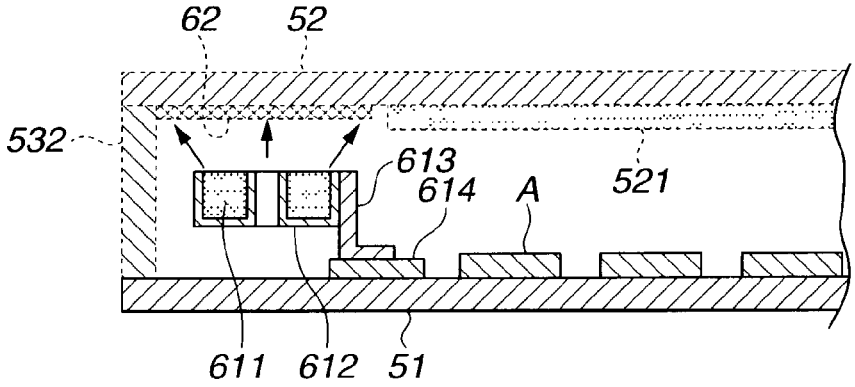
Figure 6C:
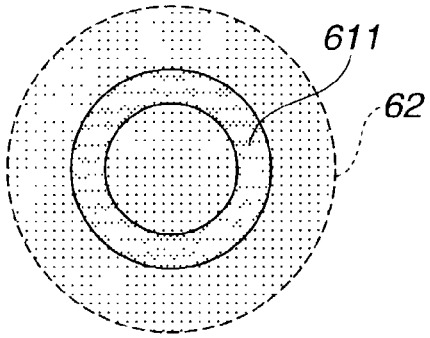
Figure 7A:
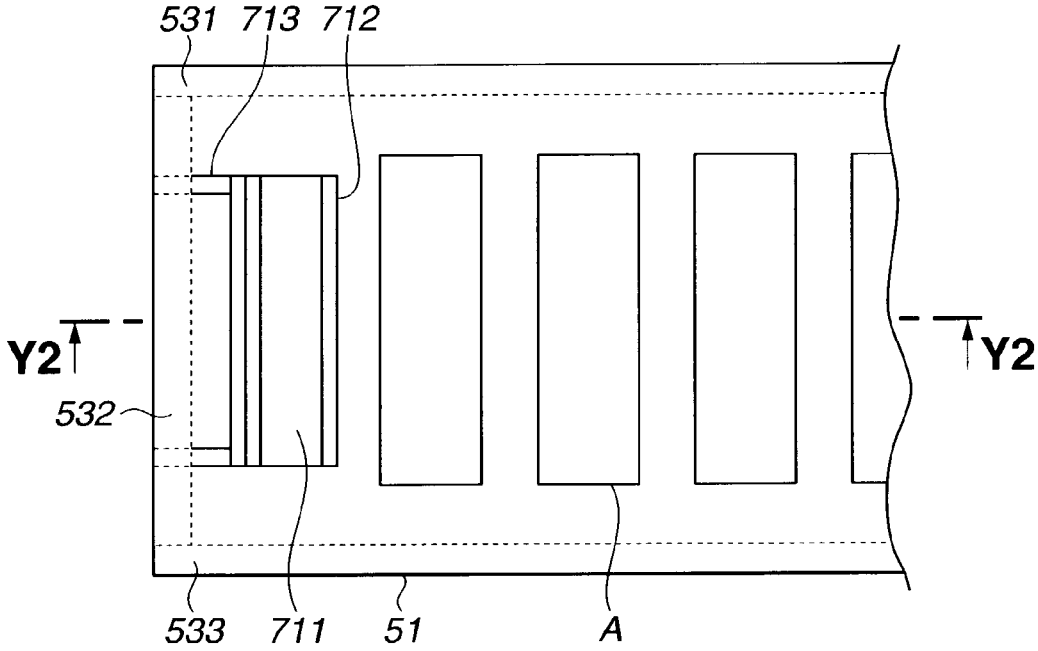
FIG. 7(*a*) is a plan view partially illustrating a conventional fluorescent luminous tube with a linear getter.
Figure 7B:
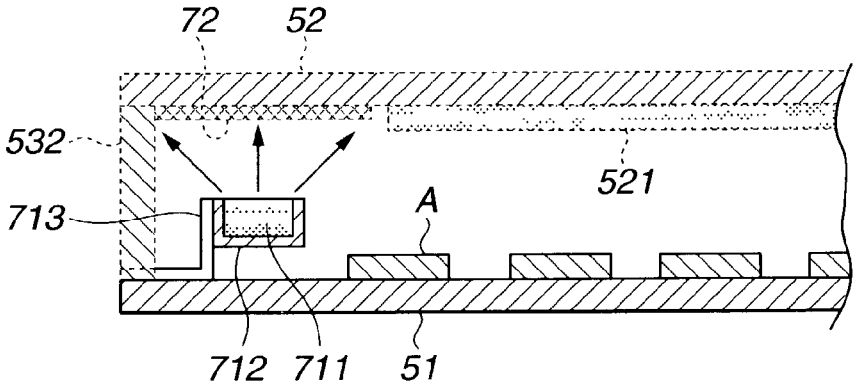
Figure 7C:
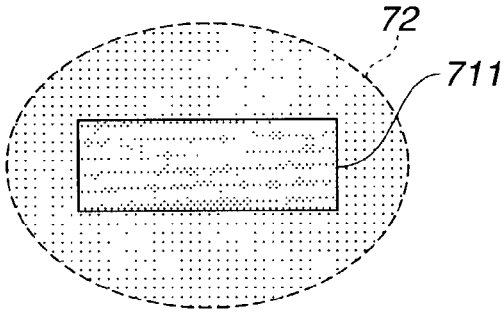

FIG. 4 is a plan view illustrating a front substrate with a getter mirror film, according to a third embodiment of the present invention.

Referring to FIG. 4(*a*), a U-shaped (or equality-sign-like) ring-less getter (not shown) is mounted on an anode substrate. The illumination spot of a laser beam is moved over the ring-less getter (not shown) along the U-shaped scanning line. Thus, a U-shaped (or equality-sign-like) getter mirror film 421, corresponding to the U-shaped scanning line, is formed around the display area 121 on the inner surface of the front substrate 12. The linear burnt region 431 which has substantially the same shape and size of those of the U-shaped scanning line, is formed in the getter mirror film 421.

Referring to FIG. 4(*b*), a rectangular frame-like ring-less getter (not shown) is mounted on the anode substrate. The illumination spot of a laser beam is moved over the ring-less getter along the U-shaped scanning line (not shown). Thus, the rectangular frame-like getter mirror film 422, corresponding to the rectangular frame-like scanning line, is formed around the display area 121 on the inner surface of the front substrate 12. The linear burnt region 432, having substantially the same shape and size as those of the rectangular frame-like scanning line, is formed in the getter mirror film 422. The term "rectangular frame-like" does not mean only the integrally formed rectangular frame structure but means a frame arrangement where discrete elements are arranged in a rectangular form. This definition is further applicable to the term "U-shaped".

In the present embodiment, a getter mirror film, which is formed over a broader area around the display area, can provide a larger area. The broader getter mirror film increases its gas absorption capability inside a fluorescent luminous tube, thus improving the reliability. Moreover, gases are continuously released off inside a fluorescent luminous tube during glowing of the fluorescent luminous tube. The released gases consume the getter mirror film. Therefore, an increased area of a getter mirror film can prolong the serviceable life of a fluorescent luminous tube. Particularly, the getter mirror film, which is formed on the getter mirror film, the front substrate, the anode substrate, or the side plate so as to surround the display area, can uniformly absorb gases. Moreover, this can reduce variations in luminous of a fluorescent substance, thus improving the display quality. For that purpose, a rectangular frame-like arrangement is preferable.

The shape of a getter mirror film should not be limited only to the above-mentioned embodiments. The shape of a getter mirror film may be arbitrary, for example, linear (rod-like), triangular, oval, in a character shape, and in a mark shape. A combination of getter mirror films different in shape or size can be used in accordance with the ring-less getter mounting place or the getter mirror film forming place.

FIG. 5 is a cross sectional view illustrating a fluorescent luminous tube having a getter mounting place and having a getter mirror film forming place, according to a fourth embodiment of the present invention. Like numerals are attached to the same elements as those in FIG. 1.

Referring to FIGS. 5(*a*), 5(*b*), 5(*c*), and 5(*d*), numeral 45 represents a ring-less getter formed of a metal layer 451 and a getter materal layer 452. Numeral 48 represents a getter mirror film. Numeral 471 represents a cathode filament. Numeral 472 represents a filament support (e.g. anchor or support). Numeral 122 represents a face glass.

Referring to FIG. 5(*a*), the ring-less getter 45 is firmly fixed to the support 472 by means of ultrasonic bonding. The surface from which the getter material layer 452 evaporates confronts the side plate 132. In such a structure, when a laser beam L is illuminated to the getter material layer 452 from the outside of the translucent side plate 132, the getter material evaporates and spatters out toward the side plate 132. Thus, a getter mirror film 48 is formed on the inner surface of the side plate 132. In other words, the getter mirror film 48 is formed on the inner surface of the side plate 132 through which the laser beam L passes.

Referring to FIG. 5(*b*), the ring-less getter 45 is firmly fixed to the support 472 and is disposed in such a way that the evaporation surface of the getter material layer 452 confronts the front substrate 12. In such a structure, the laser beam L is illuminated onto the getter material layer 452 from the outside of the translucent front substrate 12 to form the getter mirror film 48 on the surface of the front substrate 12.

Referring to FIG. 5(*c*), a box-like face glass 122 is used, which is formed by integrally assembling the front substrate 12 and four side plates 132 (here, one side plate only is shown) shown in FIG. 5(*a*). The ring-less getter 45 is firmly fixed to the front surface 1221 of the face glass 122. The surface from which the getter material layer 452 evaporates confronts the side surface 1222 of the face glass 122. In this structure, a laser beam L is illuminated onto the getter material layer 452 from the outside of the translucent side plate 132 to form the getter mirror film 48, which is formed on the inner surface of the side plate 1222.

Referring to FIG. 5(*d*), the ring-less getter 45 is firmly fixed to the anode substrate 11. The surface from which the getter material layer 452 evaporates confronts the side plate 132. In such a structure, the laser beam L is illuminated onto the getter material layer 452 from the outside of the translucent side plate 132 to form the getter mirror film 48.

In the present embodiment, the laser beam L is scanned along a predetermined pattern, in a manner similar to those in the above-mentioned embodiments. A burnt region, which has the same shape and size as those of the scanning line of the laser beam L, is formed in the getter mirror film 48.

It is now assumed that the surface, which is opposite to the surface of the support or the substrate on which a ring-less getter is mounted, defines as an upper surface. As shown in FIGS. 5(*a*) and 5(*b*), the laser beam is illuminated perpendicularly to the upper surface of the ring-less getter. Instead, as shown in FIGS. 5(*c*) and 5(*d*), the laser beam is illuminated perpendicularly to the side surface of the ring-less getter (to the plane crossing the upper surface).

In modification, the laser beam may be illuminated obliquely with respect to the upper surface or side surface of the ring-less getter. In this case, when the laser beam illumination angle is deflected toward the horizontal direction from the vertical direction, for example, from 90° to 30° or less or to 15° or less, the getter mirror film forming portion on the inner surface of the envelope and the laser beam passing portion can be separated from each other. Thus, a getter mirror film can be created without partially forming a burnt region.

The ring-less getter 45 may be circular, oval, polygonal, or ribbon-like.

In the present embodiments, the example where a ring-less getter is mounted on the filament support has been described. However, the ring-less getter may be mounted on other metal component e.g. grid support or damper support.

In the previous embodiments, the laser beam is illuminated onto the exposed surface of the ring-less getter. For that reason, the ring-less getter can be mounted on the substrate over which an insulating layer is formed.

In the previous embodiments, the laser beam is illustrated to the ring-less getter attached on the anode substrate from the outside of the front substrate and thus forms a getter mirror film on the front surface. (When an NESA film exists, a getter mirror film is formed on the NESA film.) That is, the substrate through which the laser beam passes corresponds to the substrate on which the getter mirror film is formed. Therefore, even if the laser beam cannot be illuminated from the side of the substrate on which insulating layers and wiring conductors are formed, the getter mirror film can be formed using the laser beam. In other words, if a laser beam can penetrate the anode substrate or the front substrate, a getter mirror film can be formed using the laser beam.

Another method may be considered of preparing a front substrate on which a ring-less getter is mounted and then illuminating a laser beam onto the back surface of the ring-less getter through the front substrate. However, in this method, the laser beam cannot evaporate a thick ring-less getter. Moreover, in the case of a thin (film) ring-less getter, if the energy or focal point of a laser beam is not controlled with high precision, the laser beam may crack the front substrate. For that reason, that method makes it difficult to fabricate a fluorescent luminous tube. Moreover, when the ring-less getter with a two-layered structure is used, the metal layer reflects back the laser beam so that the ring-less getter cannot be evaporated.

The ring-less getters have been explained according to the above-mentioned embodiments. However, the present invention should not be limited only to the above-mentioned embodiments. The present invention is applicable to the getter of the type which has a ring envelope or a linear envelope, filled with a getter material.

In explanation, the above-mentioned embodiments have been embedded to a fluorescent luminous tube. However, the present invention is applicable to fluorescent luminous tubes for fluorescent print heads each utilizing the principle of a fluorescent luminous tube, CRTs, plasma displays, and equivalents.

According to the present invention, the scanning length, diameter and shape of a laser beam scanning line as well as the number of scanning lines can be suitably selected. Thus, getter mirror films of various sizes each corresponding to the shape of a scanning line can be formed at desired places. Hence, the getter mirror film can flexibly follow the size or shape of a getter mounting place or a getter mirror forming place. A combination of getter mirror films having various sizes and shapes may be used. By doing so, dead spaces inside a fluorescent display tube can be effectively utilized to mount a getter and to form a getter mirror film.

Recently, fluorescent luminous tubes (electron tubes), particularly, fluorescent display tubes have been brought to realize high density in display, thinning, and weight reduction. This trend leads to restricting the place where a getter is mounted. For countermeasures, it has been demanded to improve the degree of freedom of the getter mounting place and to utilize the limited getter mounting place as effectively as possible and to form as many getter mirror films as possible. The present invention can solve such demands.

According to the present invention, to control the getter mirror film formation position, the position where the illumination spot of a laser beam moves over a getter, or the position of the scanning line, is adjusted. Therefore, after assembly, evacuation and sealing of a fluorescent display tube have finished, the position of a laser beam scanning line can be determined at the step of finally forming a getter mirror film. Even if the getter is mounted in displacement, the getter mirror film can be formed at a predetermined place by adjusting the position of the scanning line. In the conventional art, the size and shape of a getter mirror as well as the size, shape and mounting place of a getter are automatically determined uniquely. In such a state, a getter mounted in displacement causes a portion of a getter mirror film to be formed on the display area. As a result, the completed fluorescent display tube is rejected as a defective item. In contrast, the present invention does not produce defective items of that type, thus improving the manufacturing yields of fluorescent display tubes.

According to the present invention, a burnt region occurs in a getter mirror film. However, because the shape of the burnt region is nearly matched with the shape of the scanning line along which the illumination spot of a laser beam moves, the shape of the scanning line can be recognized based on the shape of the burnt region. For that reason, by detecting the shape and position of a burnt region in a getter mirror film within a completed fluorescent display tube, the shape and position of the getter mirror film formed therein can be recognized. In other words, by detecting the shape or position of the burnt portion, goodness or defectiveness of the getter mirror film completed in a fluorescent display tube can be inspected by detecting the size and shape of the burnt region.

The evaporation amount of a getter material depends on the output and beam diameter (spot diameter) of an illuminated laser beam. In order to find the diameter of a laser beam diameter, there are two methods. That is, one method includes the steps of destructing a completed fluorescent display tube and then measuring the width of a laser beam scanning line engraved in a getter material. The other method includes the steps of fabricating a mock tube for measurement to which a getter material for measurement is attached, illuminating a laser beam onto the getter material, and then measuring the width of a laser beam scanning line engraved in the getter material. The former method requires destruction of a completed fluorescent display tube while the latter method requires preparing a mock tube. In contrast, according to the present invention, the beam diameter of a laser beam can be simply detected based on the line width of a burnt portion in a getter mirror film formed in the getter mirror film forming step. Hence, in the fluorescent display tube fabricating step, the beam diameter of a laser beam can be detected at all times. The amount of a getter material in a getter mirror film is estimated based on the detection results. When the amount of the getter material in the getter mirror film is insufficient, the laser beam is further illuminated to add the getter material for the getter mirror film. In the present invention, because the amount of a getter material for the getter mirror film is monitored and controlled in the fluorescent display tube fabrication step, the fluorescent display tube can be easily fabricated and the fabrication yields can be improved.

According to the present invention, because a thick getter can be formed through press molding, the laser beam cannot penetrate the getter in the laser illumination step. Hence, the wiring conductors formed on the anode substrate are not damaged. Moreover, the two-layered structure of a getter material layer and a metal layer reflects a laser beam so that the damage caused by laser illumination can be prevented more effectively.

According to the present invention, a laser beam penetrates the substrate on which a getter mirror film is formed. Hence, if either one of substrates juxtaposed allows a laser beam to pass through, a getter mirror film can be formed using the laser beam.

Moreover, according to the present invention, because a getter mirror film is formed using a laser beam, components other than the getter are not heated, unlike the radio-frequency induction heating method. Hence, other components are not damaged through heating in the getter mirror film forming process.

Moreover, according to the present invention, because the ring-less getter does not require a special container or member filled with a getter material, the getter structure can be simplified and the mounting work can be facilitated. Hence, the fabrication costs for getters and fluorescent display tubes can be reduced. Moreover, the small, simplified ring-less getter enables a fluorescent display tube to be thinned and miniaturized.

What is claimed is:

1. A fluorescent luminous tube, comprising:

an envelope including a first substrate and a second substrate that confront each other, and side members;

an anode disposed inside said envelope, said anode on which a fluorescent substance is coated;

a getter mounted inside said envelope; and a getter mirror film formed on an inner surface of said second substrate of said envelope;

said getter mirror film being formed by illuminating a laser beam onto said getter from the outside of said envelope through said second substrate and moving the illumination spot of said laser beam along a scanning line in a predetermined shape, whereby a surface of said getter is evaporated along said scanning line to form said getter mirror film corresponding to the shape of said scanning line on said inner surface of said second substrate of said envelope through which said laser beam passes;

said getter mirror film having a burnt region having substantially the same size and shape as those of said scanning line.

2. The fluorescent luminous tube as defined in claim 1, wherein the distance between the laser beam illumination surface of said getter and the inner surface of said second substrate of is 1 mm or less; and wherein the beam diameter of said laser beam is 100 $\mu$m or less.

3. The fluorescent luminous tube as defined in claim 1, wherein said getter is formed by press molding a getter material.

4. The fluorescent luminous tube as defined in claim 3, wherein said getter comprises a two layered structure of a getter material layer and a metal layer.

* * * * *

UNITED STATES PATENT AND TRADEMARK OFFICE

CERTIFICATE OF CORRECTION

PATENT NO. : 6,979,949 B2
DATED : December 27, 2005
INVENTOR(S) : Yonezawa et al.

It is certified that error appears in the above-identified patent and that said Letters Patent is hereby corrected as shown below:

Title page,
Insert Item -- [30] Foreign Application Priority Data
Jul. 9, 2001 (JP) …….. 2001-207365 --.

Signed and Sealed this

Twenty-first Day of February, 2006

JON W. DUDAS
*Director of the United States Patent and Trademark Office*